US009083079B2

(12) United States Patent
Tseng et al.

(10) Patent No.: US 9,083,079 B2
(45) Date of Patent: Jul. 14, 2015

(54) WIRELESS LOCAL AREA NETWORK ADAPTER

(71) Applicant: Chi Mei Communication Systems, Inc., New Taipei (TW)

(72) Inventors: Ting-Chih Tseng, New Taipei (TW); Kun-Lin Sung, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 188 days.

(21) Appl. No.: 13/775,110

(22) Filed: Feb. 22, 2013

(65) Prior Publication Data

US 2013/0342418 A1 Dec. 26, 2013

(30) Foreign Application Priority Data

Jun. 25, 2012 (TW) ..... 101212194

(51) Int. Cl.

| | |
|---|---|
| ***H01Q 1/24*** | (2006.01) |
| ***H01Q 1/48*** | (2006.01) |
| ***H01Q 1/22*** | (2006.01) |
| ***H01Q 9/42*** | (2006.01) |

(52) U.S. Cl.

CPC ..... *H01Q 1/48* (2013.01); *H01Q 1/2275* (2013.01); *H01Q 9/42* (2013.01)

(58) Field of Classification Search

CPC ..... H01Q 1/2275
USPC ..... 343/702, 846, 848, 906
See application file for complete search history.

(56) References Cited

U.S. PATENT DOCUMENTS

| | | | | |
|---|---|---|---|---|
| 5,646,635 | A * | 7/1997 | Cockson et al. | 343/702 |
| 6,266,017 | B1 * | 7/2001 | Aldous | 343/702 |
| 6,518,927 | B2 * | 2/2003 | Schremmer et al. | 343/702 |
| 6,545,643 | B1 * | 4/2003 | Sward et al. | 343/702 |
| 7,623,078 | B2 * | 11/2009 | Wang | 343/702 |
| 7,889,140 | B2 * | 2/2011 | Wong et al. | 343/702 |
| 8,451,188 | B2 * | 5/2013 | Won et al. | 343/906 |
| 8,866,696 | B2 * | 10/2014 | Kazanchian | 343/906 |

* cited by examiner

*Primary Examiner* — Tho G Phan
(74) *Attorney, Agent, or Firm* — Novak Druce Connolly Bove + Quigg LLP

(57) ABSTRACT

A wireless local area network adapter includes a housing, a printed circuit board, an antenna, at least one elastic sheet and a plug. The printed circuit board includes a first ground plane. The antenna is electronically connected to the first ground plane. The elastic sheet is positioned on the printed circuit board, and is electronically connected to the first ground plane. The plug includes a shell, at least one part of the shell made of metal, the at least one elastic sheet contacting the metal part of the shell for electronically connecting the shell.

6 Claims, 5 Drawing Sheets

WIRELESS LOCAL AREA NETWORK ADAPTER

BACKGROUND

1. Technical Field

The disclosure generally relates to wireless local area network (LAN) adapters, and particularly, to a wireless LAN adapter used with a computer.

2. Description of the Related Art

A wireless LAN adapter is a wireless terminal device using a wireless LAN which has been configured for connecting to the Internet or other networks. Wireless LAN adapters can be divided into several types, according to their different interfaces. Wireless LAN adapters having a USB interface for data exchange are widely used.

The wireless LAN adapter generally includes an antenna to transmit and receive electromagnetic waves. Typical wireless LAN adapters usually have a bad grounding effect for the antenna.

Therefore, there is room for improvement within the art.

BRIEF DESCRIPTION OF THE DRAWINGS

Many aspects of an exemplary wireless LAN adapter can be better understood with reference to the following drawings. The components in the drawings are not necessarily drawn to scale, the emphasis instead being placed upon clearly illustrating the principles of the exemplary wireless LAN adapter. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
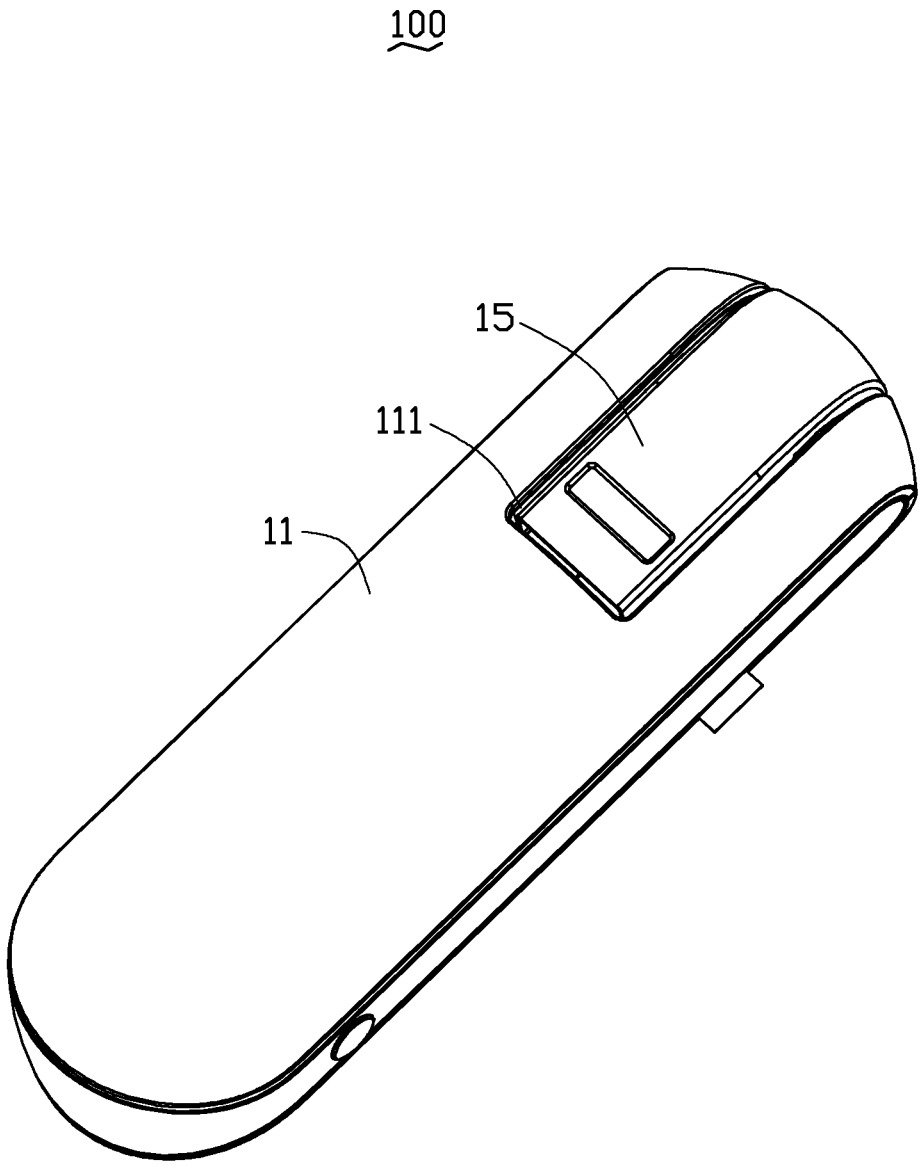
FIG. 1 is a schematic view of a wireless LAN adapter according to an exemplary embodiment.
Figure 2:
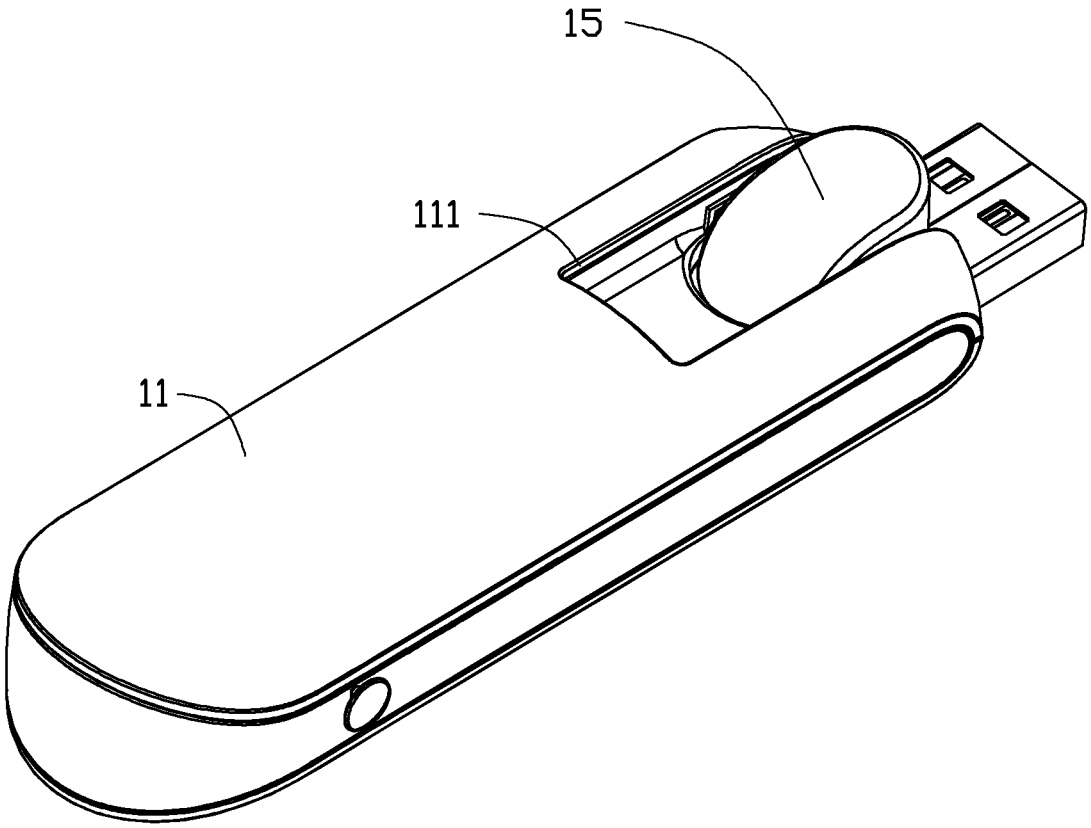
FIG. 2 is a schematic view of the wireless LAN adapter shown in FIG. 1, showing the plug to be rotated to a used state.

FIGS. 1 and 2 show an exemplary embodiment of a wireless local area network (LAN) adapter 100 used in an electronic device. The electronic device may be, for example, a cellular telephone, a personal digital assistant, a remote controller, or a laptop computer. The electronic device and wireless LAN adapter 100 may communicate wirelessly with any suitable electronic equipment. The wireless LAN adapter 100 includes a housing 11 and a plug 15. The housing 11 defines a receiving space 111, and a distal end of the plug 15 can be rotated out of the receiving space 111 for being connected to the electronic device.

Figure 3:
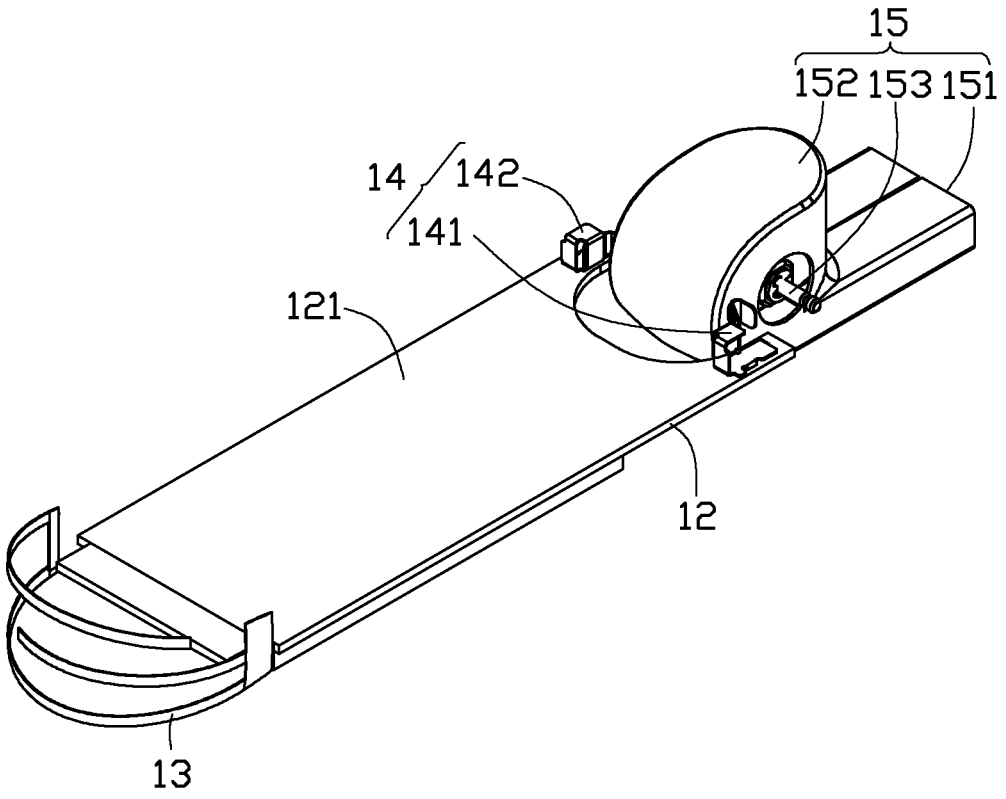
FIG. 3 is an inside schematic view of the wireless LAN adapter shown in FIG. 2.

FIG. 3 shows an inside structure of the wireless LAN adapter 100. A printed circuit board 12, an antenna 13, at least one elastic sheet 14 are positioned in the housing 11. The printed circuit board 12 has a first ground plane 121. The antenna 13 is positioned at one side of the printed circuit board 12, and may be formed from any suitable antenna structure. For example, the antenna 13 may be planar inverted F antenna (PIFA). The antenna 13 is electrically connected to the first ground plane 121.

The elastic sheet 14 is made of metal, and is positioned at the side of the printed circuit board 12 opposite to the antenna 13, configured for electrically connecting to the first ground plane 121. In this exemplary embodiment, there are a first elastic sheet 141 and a second elastic sheet 142 on the printed circuit board 12, and are respectively positioned on two sides of the plug 15.

Figure 4:
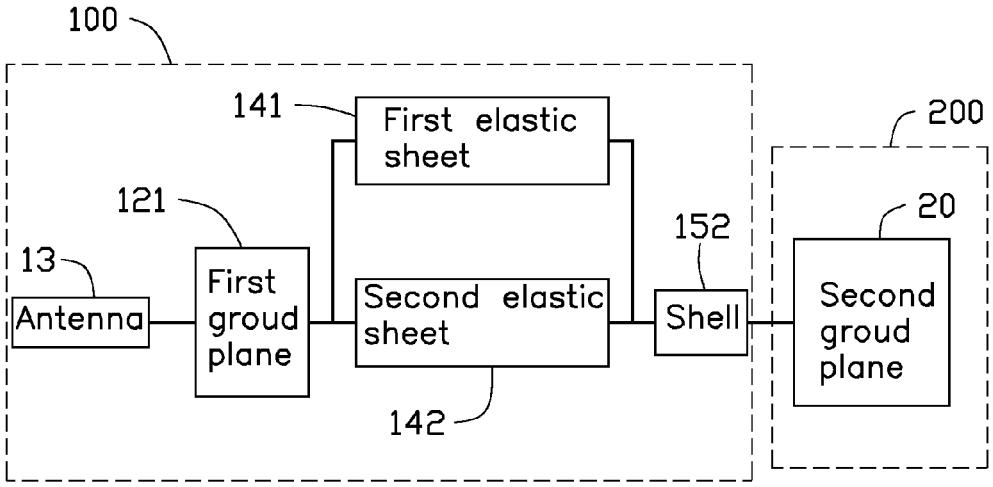
FIG. 4 is a block diagram illustrating a ground route of an antenna in the wireless LAN adapter electrically connected to an electronic device.

The plug 15 includes a connector 151, a shell 152 and a pair of pivotal shafts 153. FIG. 4 shows a block diagram of the wireless LAN adapter 100 connected to an electronic device 200. The connector 151 is a Universal Serial Bus (USB) interface, and is configured for being plugged in the electronic device 200. The electronic device 200 includes a port (not shown) and a second ground plane 20. The shell 152 forms an outer sheath portion for the connector 151. At least one part of the shell 152 is made of metal, and the first, second elastic sheets 141, 142 directly contact the metal part of the shell 152 for allowing the first, second elastic sheets 141, 142 to be electrically connected to the shell 152. When the connector 151 is plugged in the port of the electronic device 200, the shell 152 is electrically connected to the second ground plane 20. Thus, the antenna 13 is electrically connected to the second ground plane 20 in the electronic device 200 to exhibit a high efficiency. The ground effect of the antenna 13 is greatly improved. The pair of pivotal shafts 153 is rotatably connected to the housing 11 for allowing the plug 15 to be rotated about the pivotal shafts 153.

Figure 5:
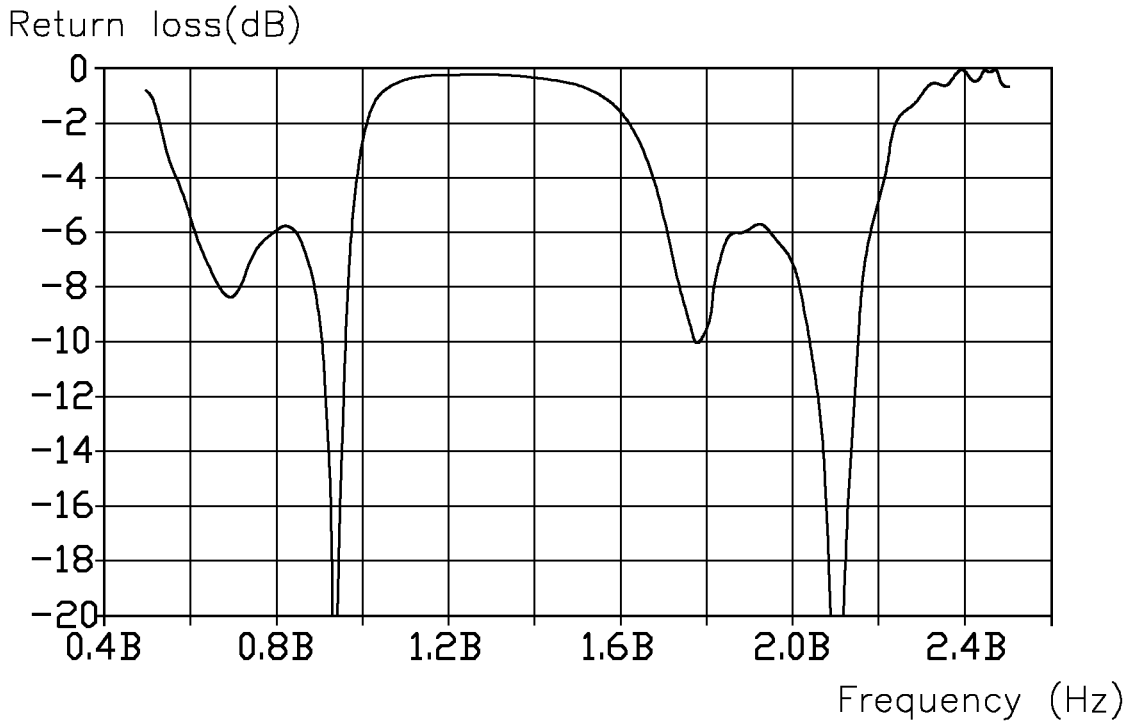
FIG. 5 is a diagram showing return loss measurement of the antenna shown in FIG. 1.

FIG. 5 show that the return loss (RL) of the antenna 13 is less than −6 dB when the antenna 13 receives/sends wireless signals at a frequency range of 824 MHz-960 MHz 1710 MHz-2170 MHz. The wireless LAN adapter 100 may work using GSM, EGSM, DCS, PCS and WCDMA networks.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A wireless local area network (LAN) adapter, comprising:

a housing;

a printed circuit board received in the housing, the printed circuit board including a first ground plane;

an antenna electrically connected to the first ground plane;

at least one elastic sheet positioned on the printed circuit board, and electrically connected to the first ground plane; and a plug including a shell, wherein at least one part of the shell is made of metal, and wherein the at least one elastic sheet contacts the metal part of the shell for being electrically connected to the shell.

2. The wireless LAN adapter as claimed in claim 1, wherein the at least one elastic sheet includes a first elastic sheet and a second elastic sheet positioned at two sides of the plug.

3. The wireless LAN adapter as claimed in claim 1, wherein the plug includes a pair of pivotal shafts, the pivotal shaft are rotatably connected to the housing.

4. An electronic device, comprising:

a wireless LAN adapter comprising:

an antenna;

a printed circuit board including a first ground plane;

at least one elastic sheet positioned on the printed circuit board, and electrically connected to the first ground plane; and a plug including a shell, at least one part of the shell made of metal, the at least one elastic sheet contacting the metal part of the shell for electrically connecting the shell; and a port with a second ground plane, the plug plugged in the port;

wherein the antenna is electrically connected to the first ground plane, the at least one elastic sheet is electrically connected between the first ground plane and the shell, the shell is electrically connected to the second ground plane.

5. The electronic device as claimed in claim 4, wherein the elastic sheet includes a first elastic sheet and a second elastic sheet positioned at two sides of the plug.

6. The electronic device as claimed in claim 4, wherein the plug includes a pair of pivotal shafts, the pivotal shaft are rotatably connected to the housing.

* * * * *